US010119280B2

(12) United States Patent
Calmes

(10) Patent No.: US 10,119,280 B2
(45) Date of Patent: Nov. 6, 2018

(54) FORM LINER FOR VISUALLY ENHANCED CONCRETE

(71) Applicant: Advanced Formliners, LLC, Onalaska, WI (US)

(72) Inventor: Shane Calmes, Onalaska, WI (US)

(73) Assignee: Advanced Formliners, LLC, Onalaska, WI (US)

( * ) Notice: Subject to any disclaimer, the term of this patent is extended or adjusted under 35 U.S.C. 154(b) by 237 days.

(21) Appl. No.: 14/796,626

(22) Filed: Jul. 10, 2015

(65) Prior Publication Data

US 2016/0010346 A1 Jan. 14, 2016

Related U.S. Application Data

(60) Provisional application No. 62/023,726, filed on Jul. 11, 2014.

(51) Int. Cl.

| | |
|---|---|
| ***E04G 9/10*** | (2006.01) |
| ***B28B 7/36*** | (2006.01) |
| ***B28B 19/00*** | (2006.01) |
| ***B28B 7/00*** | (2006.01) |

(52) U.S. Cl.

CPC ..... *E04G 9/10* (2013.01); *B28B 7/0073* (2013.01); *B28B 7/362* (2013.01); *B28B 7/364* (2013.01); *B28B 19/0007* (2013.01); *B28B 19/0061* (2013.01)

(58) Field of Classification Search

CPC ..... B28B 7/0073; B28B 7/36; B28B 7/362; B28B 7/364; B28B 19/0007; E04G 9/10

See application file for complete search history.

(56) References Cited

U.S. PATENT DOCUMENTS

| | | | |
|---|---|---|---|
| 636,200 | A | 10/1899 | Frink |
| 777,656 | A | 12/1904 | Banning |
| 1,564,578 | A | 12/1925 | Kennedy |
| 1,809,504 | A | 6/1931 | Carvel |
| 1,896,188 | A | 2/1933 | Shanklin |
| 1,945,024 | A | 1/1934 | Coil |
| 2,114,710 | A | 4/1938 | Holcomb |
| 2,283,968 | A | 5/1942 | Bunch |
| 2,355,967 | A | 8/1944 | Greenwalt |
| 2,465,871 | A | 3/1949 | Hardie et al. |
| 2,627,100 | A | 2/1953 | Jelks |
| 2,654,935 | A | 10/1953 | Ager |

(Continued)

FOREIGN PATENT DOCUMENTS

| | | | | |
|---|---|---|---|---|
| CA | 2512237 | A1 * | 1/2006 | ..... B29C 33/424 |
| DE | 4309128 | A1 * | 9/1993 | ..... C09D 171/02 |

(Continued)

*Primary Examiner* — Michael Safavi

(74) *Attorney, Agent, or Firm* — Vidas, Arnett & Steinkraus

(57) ABSTRACT

In some embodiments, a cured panel is formed from a curable material and comprises at least one enhancing material applied to a surface of the panel or embedded in a surface of the panel. In some embodiments, a method comprises providing a form liner having an enhancing material oriented on or attached to the form liner, and then providing a curable material. In some embodiments, a method comprises providing a form liner having at least one cavity containing a curable mixture, and then providing a curable material.

15 Claims, 5 Drawing Sheets

(56) References Cited

U.S. PATENT DOCUMENTS 2,782,469 A 2/1957 Hargraves
2,858,247 A 10/1958 De Swart
2,876,927 A 3/1959 Henning
2,887,756 A 5/1959 Brechel
2,964,800 A 12/1960 Dorsett
2,974,716 A 3/1961 Fourness
3,349,158 A 10/1967 Maynard
3,382,640 A 5/1968 Thomas
3,411,257 A 11/1968 Yaremchuk
3,419,457 A 12/1968 Bleasdale
3,530,029 A 9/1970 Lemelson
3,594,968 A 7/1971 Johnson
3,602,476 A 8/1971 Iragorri
3,664,630 A 5/1972 Maynen
3,783,087 A 1/1974 Vecchiarelli
3,801,405 A 4/1974 Corkery
3,908,326 A 9/1975 Francis
4,011,702 A 3/1977 Matyas
4,055,322 A * 10/1977 Cassidy ..... B28B 7/362 249/112
4,132,043 A * 1/1979 Juba ..... B28B 19/0046 264/134
4,133,481 A 1/1979 Bennett
4,239,824 A 12/1980 Kasten
4,393,108 A 7/1983 Barker
4,420,525 A * 12/1983 Parks ..... B28B 7/0064 264/245
4,695,033 A 9/1987 Imaeda
4,858,410 A 8/1989 Goldman
4,859,511 A 8/1989 Patterson
4,888,928 A 12/1989 Rea
4,889,758 A 12/1989 Rinkewich
4,923,733 A 5/1990 Herbst
4,957,798 A 9/1990 Bogdany
4,963,054 A 10/1990 Hayashi
4,994,053 A * 2/1991 Lang ..... A61F 13/15634 428/117
5,002,817 A 3/1991 Jones
5,006,011 A 4/1991 Hiyashi
5,038,541 A 8/1991 Gibbar, Jr.
5,074,517 A 12/1991 Scott
5,162,150 A 11/1992 Buis
5,225,134 A * 7/1993 Nasvik ..... B28B 7/0073 249/102
5,242,738 A 9/1993 Furuya
5,250,336 A * 10/1993 Greuse ..... G09F 3/0292 428/352
5,268,137 A 12/1993 Scott
5,268,213 A 12/1993 Murakami
5,277,009 A 1/1994 Yamaguchi
5,421,670 A 6/1995 Meirick
5,487,929 A 1/1996 Rusincovitch, Jr.
5,489,462 A 2/1996 Sieber
5,540,411 A 7/1996 Strickland
5,589,246 A 12/1996 Calhoun
5,603,878 A * 2/1997 Jinno ..... B28B 7/362 156/232
5,627,231 A * 5/1997 Shalov ..... B05D 1/28 524/284
5,637,236 A * 6/1997 Lowe ..... B28B 7/007 216/30
5,667,190 A 9/1997 Scott
5,701,710 A 12/1997 Tremelling
5,787,667 A 8/1998 Sheahan
5,822,937 A 10/1998 Mahony
5,830,548 A * 11/1998 Andersen ..... B28B 1/00 206/524.3
5,887,846 A 3/1999 Hupp
5,900,180 A * 5/1999 Scott ..... B28B 19/0061 249/61
5,906,883 A 5/1999 Blanc-Brude
6,024,339 A 2/2000 Gates
6,041,567 A 3/2000 Passeno
6,059,257 A 5/2000 Scott, III
6,127,020 A 10/2000 Bacon, Jr.
6,164,037 A 12/2000 Passeno
6,335,073 B1 1/2002 Kock
6,355,193 B1 * 3/2002 Stott ..... B28B 7/0073 156/245
6,408,585 B1 6/2002 Tajima
6,541,098 B2 4/2003 Venkatasanthanam
D479,614 S 9/2003 Scott
6,716,520 B2 4/2004 Cook, II
6,857,248 B2 2/2005 Ouellet
6,858,285 B1 2/2005 Hamilton
7,658,050 B2 2/2010 Bouchard
7,871,054 B2 1/2011 Walters
7,896,309 B1 3/2011 DiGiammo
7,963,499 B2 6/2011 Fitzgerald
D648,450 S 11/2011 Drummond
8,074,957 B2 12/2011 Fitzgerald
8,181,930 B2 5/2012 Fasching
D674,517 S 1/2013 Scott, III
D704,865 S 5/2014 Calmes
D704,866 S 5/2014 Calmes
8,852,724 B2 10/2014 Calmes
8,888,067 B1 11/2014 Calmes
2001/0023559 A1 * 9/2001 Ozawa ..... B28B 1/002 52/100
2002/0106504 A1 8/2002 Stott
2004/0131846 A1 7/2004 Epple
2004/0142131 A1 * 7/2004 Edwards ..... B32B 27/08 428/35.7
2004/0200168 A1 10/2004 Takagi
2004/0226230 A1 11/2004 Ritzer
2005/0064128 A1 3/2005 Lane
2005/0097827 A1 5/2005 Jordan
2006/0091282 A1 5/2006 Walters
2006/0131475 A1 6/2006 Testa
2006/0157634 A1 * 7/2006 Nasvik ..... B28B 7/0073 249/16
2006/0180731 A1 8/2006 Scott
2007/0151184 A1 7/2007 Wise
2007/0209308 A1 9/2007 Barrett
2007/0217865 A1 9/2007 Castonguay
2008/0092473 A1 4/2008 Heyns
2009/0100774 A1 4/2009 Fasching
2009/0100776 A1 4/2009 Seccombe
2010/0071308 A1 3/2010 Fitzgerald
2010/0155569 A1 6/2010 Walters
2010/0263793 A1 * 10/2010 Ylitalo ..... A01N 25/34 156/714
2010/0314527 A1 12/2010 Fitzgerald
2012/0074604 A1 3/2012 Calmes
2014/0023741 A1 * 1/2014 Grassi ..... B29D 99/001 425/115
2014/0260050 A1 9/2014 Calmes
2015/0069211 A1 3/2015 Calmes

FOREIGN PATENT DOCUMENTS

EP 0449584 10/1991
FR 2292090 6/1976
GB 2145651 A * 4/1985 ..... B28B 7/0073
JP 03082508 4/1991
JP 03137357 6/1991
JP 05039666 2/1993
JP 05044340 2/1993
JP 06092757 A * 4/1994 ..... C09D 171/02

* cited by examiner

FORM LINER FOR VISUALLY ENHANCED CONCRETE

CROSS-REFERENCE TO RELATED APPLICATIONS

This application claims the benefit of U.S. Provisional Patent Application No. 62/023,726, filed Jul. 11, 2014, the entire content of which is hereby incorporated herein by reference.

BACKGROUND OF THE INVENTION

This invention relates to curable materials such as concrete and items formed from curable materials, such as buildings, walls, floors, etc. This invention also relates to form liners that are used to form the curable materials, and methods of making and forming the curable materials.

In the last several decades, the concrete industry has been advantaged by using form liners as a method of imprinting textures into concrete structures. Concrete walls created using such form liners can include three-dimensional texturing and decorative patterns. Some concrete walls are able to simulate the look of a traditional masonry structure, such as brick and mortar, rock and mortar, etc.

Some wall structures use insert objects, such as thin brick objects, that become cast into the curable materials.

U.S. patent application Ser. Nos. 12/047128 and 12/706633 and U.S. Pat. No. 8,852,724 disclose examples of form liner systems, and are hereby incorporated herein by reference in their entireties.

There remains a need for systems and methods capable of producing cured materials that are more desirable and visually appealing than prior systems and methods.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a form liner comprises a plurality of cavities defined by a plurality of raised portions. At least one cavity comprises an enhancing material attached to a surface of the cavity. An enhancing material can comprise a polymer, sand, particulate stone or metal, powdered material, pigments, glass or various combinations thereof.

In some embodiments, a form liner comprises a plurality of cavities defined by a plurality of raised portions. At least one cavity comprises a curable mixture oriented therein. In some embodiments, a curable mixture comprises cement. In some embodiments, an enhancing material is also provided. In some embodiments, the form liner further comprises a protective film.

In some embodiments, a protective film is attached to raised portions of the form liner. In some embodiments, a protective film is water soluble or water dispersible, or otherwise arranged to dissolve or disperse in a curable material such as wet concrete.

In some embodiments, a method comprises providing a form liner comprising cavities and raised portions, wherein the form liner comprises an enhancing material in at least one cavity. In some embodiments, the enhancing material is oriented in a cavity that is defined by the raised portions. In some embodiments, the method comprises providing a form liner and applying the enhancing material to the form liner. In some embodiments, the method further comprises applying a curable material and allowing the curable material to cure into a cured material, wherein the enhancing material is retained on the cured material.

In some embodiments, a method comprises providing a form liner comprising cavities defined by raised portions, wherein the form liner comprises a curable mixture in at least one cavity. A curable material is added and allowed to cure. In some embodiments, the form liner comprises a film, and the film is removed prior to the addition of curable material. In some embodiments, the form liner comprises a film that is left in place, and a curable material is applied over the film. In some embodiments, the curable material dissolves or disperses the film.

These and other embodiments which characterize the invention are pointed out with particularity in the claims annexed hereto and forming a part hereof However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
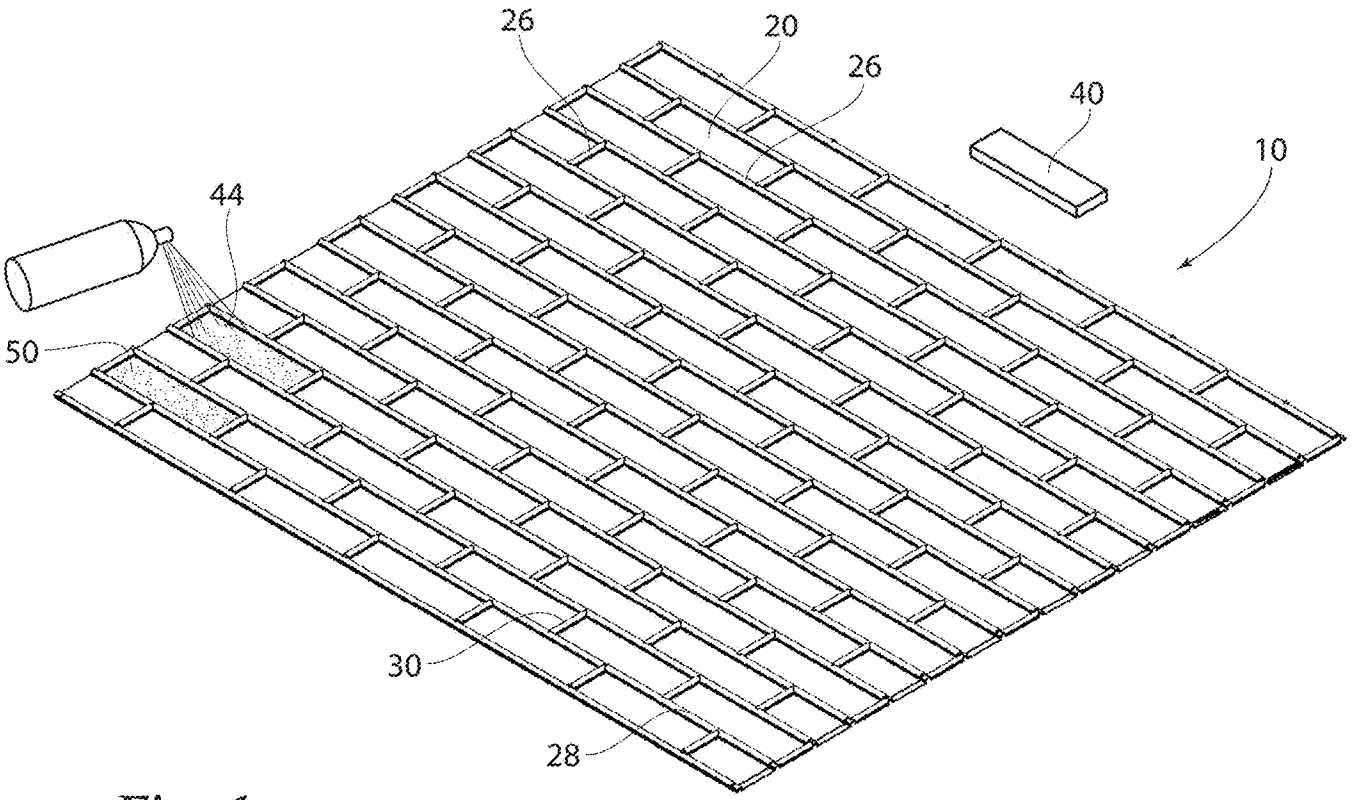
FIG. 1 shows an embodiment of a form liner.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a form liner 10 suitable for forming a curable material such as concrete. In some embodiments, a form liner 10 is suitable for imparting a surface texture to the curable material, for example creating the appearance of bricks, stone, etc. Various embodiments of a form liner 10 can have any suitable shape and impart any suitable decorative appearance to a curable material. As shown in FIG. 1, the form liner 10 is arranged to create a cured panel with the appearance of a brick wall having a running bond pattern.

In some embodiments, a form liner 10 comprises a plurality of cavities 20 separated by raised portions 26. In some embodiments, the raised portions 26 comprise a shape and surface texturing that will create the appearance of a mortar joint in the eventual cured panel. In some embodiments, one or more of the cavities 20 comprises surface texturing that will impart the appearance of face brick, stone or any other suitable object in the eventual cured panel. In various embodiments, texturing can create the appearance of bricks that are smooth, lightly textured, heavily textured, tumbled, cracked, stock, torn face, sanded, etc. Various embodiments of a form liner 10 may have any suitable arrangement of cavities 20 and raised portions 26. In some embodiments, the raised portions 26 can include first raised portions 28 that are parallel to one another and second raised portions 30 that are parallel to one another and oriented at an angle to the first raised portions 28. In some embodiments, additional raised portions 26 can be provided at an angle to both the first raised portions 28 and the second raised portions 30. The specific size, shape and arrangement of raised portions 26 can be varied to create any pattern desired in the form liner 10. Various brick-appearance patterns can have any suitable bond pattern, such as a running bond, stack bond, raking bond, English bond, Flemish bond, Header bond, Monk bond, Sussex bond, basket weave bond, herringbone bond, etc., as well as any combination thereof In some embodiments, insert objects 40 such as thin bricks can be placed in one or more of the cavities 20 prior to the application of curable material, and the object(s) 40 become cast into the cured material.

Desirably, an enhancing material 50 is placed in or on one or more portions of the form liner 10 prior to the application of curable material. In some embodiments, an enhancing material 50 is placed in one or more selected cavities 20 prior to the application of curable material. In some embodiments, the enhancing material 50 comprises particulate material such glass, metal, glitter or another visually distinctive material that can impart flash, luster, reflectiveness or other enhancement to the cured material. Any suitable combination of materials can be used as enhancing material 50.

In some embodiments, an enhancing material 50 comprises polymer flakes or fleck in any suitable size. In some embodiments, polymer flakes in sizes of ½", ¼", ⅛", 1/16" or 1/32" are used, or any suitable combination thereof In some embodiments, an enhancing material 50 comprises polyester glitter flakes. Any suitable color or combination of colors can be used.

In some embodiments, an enhancing material 50 comprises silicate minerals or mica, such as muscovite, phlogopite, biotite, clintonite, etc.

In some embodiments, an enhancing material 50 comprises a particulate material such as sand or granulated stone, such as quartz or granite granules, various metal particles, reflective beads, glass beads, microbeads, microspheres, etc. In some embodiments an enhancing material 50 comprises particles having a reflective coating, metallized glass particles, reflective or refractive particles, etc.

In some embodiments, an enhancing material 50 comprises luminescent particles such as particles comprising luminescent polymer materials, radioluminescent materials, photoluminescent materials, phosphorescent materials, bioluminescent materials, etc.

In some embodiments, an enhancing material 50 comprises pigment powders that will impart pigment to the cured material.

Any suitable combination of the various enhancing materials 50 can be used.

In some embodiments, an adhesive 44 is provided. In some embodiments, the adhesive 44 is applied to the form liner 10, and the enhancing material 50 is placed on/in the form liner 10. Desirably, the adhesive 44 will retain the enhancing material 50 on the form liner 10. The adhesive 44 may be desirable in situations where the form liner 10 is arranged vertically and the curable material is cast in a vertical position.

Any suitable adhesive 44 can be used. Desirably, the adhesive 44 will provide a light bond that temporarily retains the enhancing material 50 in the form liner 10 before curable material is applied, but allows the enhancing material 50 to leave the form liner 10 with the cured material. In some embodiments, the adhesive 44 comprises a synthetic elastomer. In some embodiments, the adhesive 44 comprises a spray such as 3M Repositionable 75 Spray Adhesive.

Figure 2:
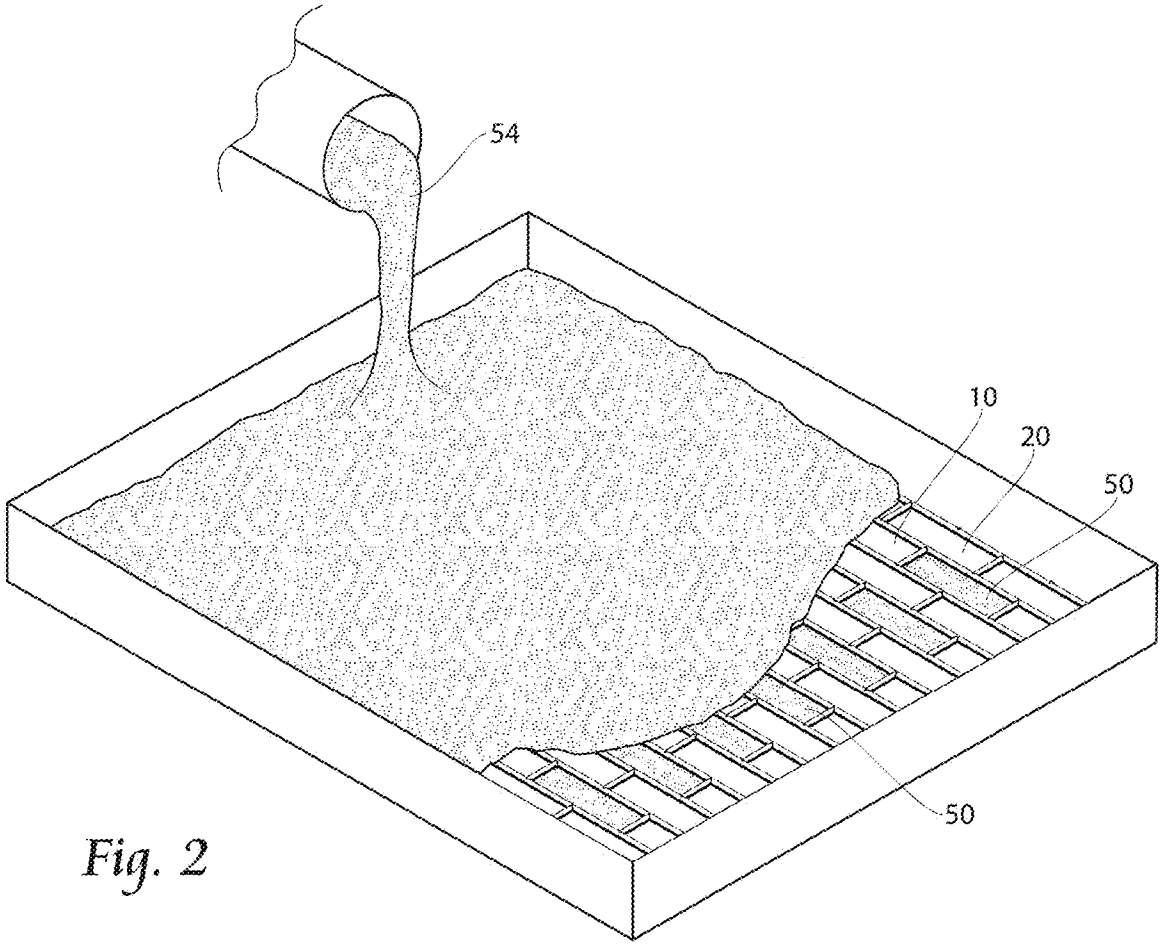
FIG. 2 shows a curable material being applied to a form liner.

FIG. 2 shows a form liner 10 having enhancing material 50 applied to selected cavities 20 in a predetermined pattern. A curable material 54 such as concrete is being poured to cast a wall panel. The enhancing material 50 will bond to a surface and/or become embedded in a surface of the curable material 54 and will be retained on the cured panel after the form liner 10 is removed. The resulting wall panel will have added visual appeal in the areas where enhancing material 50 was used.

Figure 3:
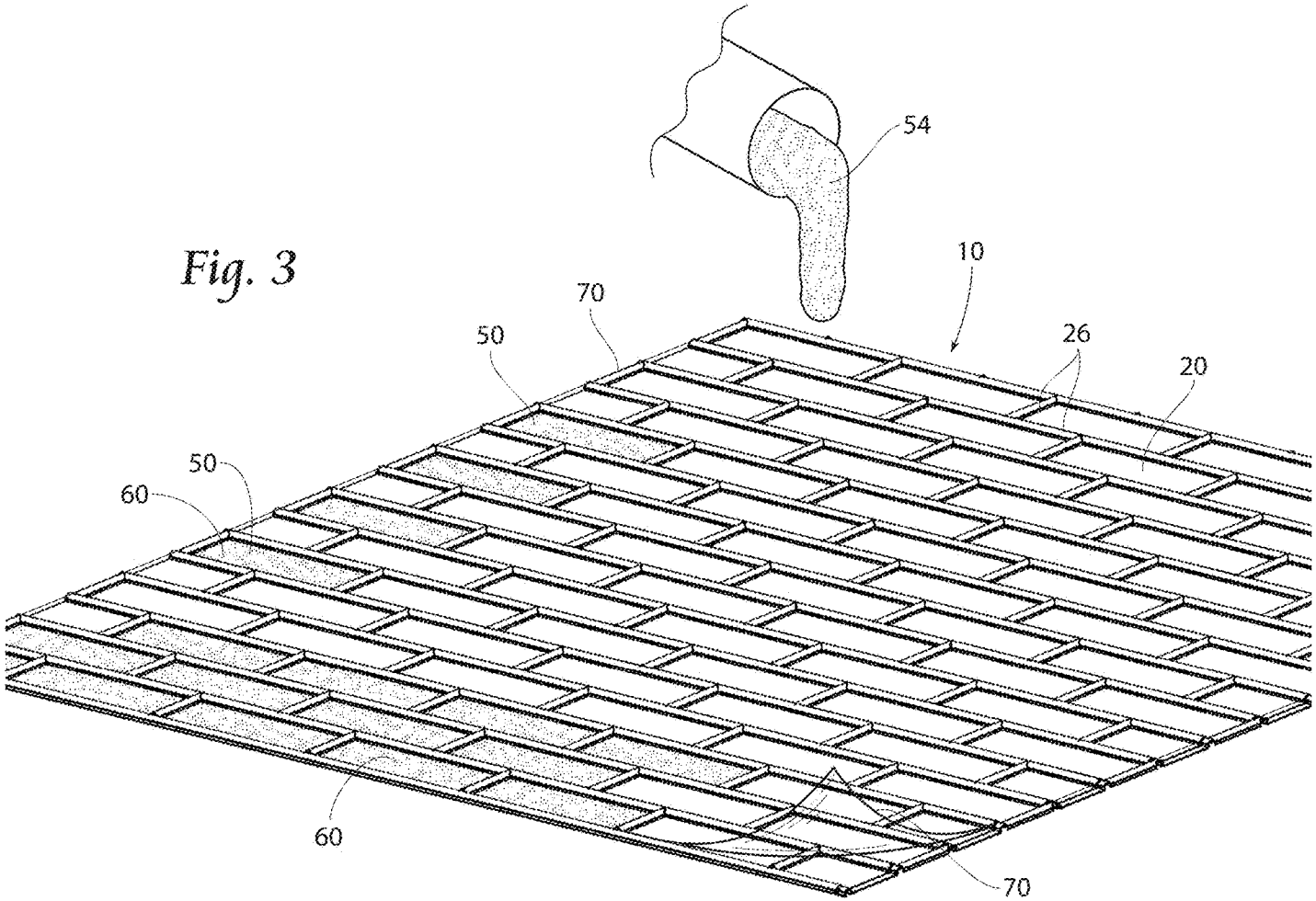
FIG. 3 shows a form liner having enhancing material and curable mixture.

FIG. 3 shows another embodiment of a form liner 10 comprising a plurality of raised portions 26 that define a plurality of cavities 20.

In some embodiments, a form liner 10 comprises a curable mixture 60 oriented in one or more cavities 20. Desirably, a curable mixture 60 comprises a dry cementous mixture comprising Portland cement. Desirably, a curable mixture 60 will become a curable material upon the addition of a suitable amount of water or moisture, and will cure and become an integral portion of a cured panel.

In some embodiments, a curable material 54 such as wet concrete mix can be poured on the form liner 10, and water or moisture from the curable material 54 will mix with the curable mixture 60. The curable mixture 60 will then bond with the added curable material 54 and become curable material, and form an integral portion of the cured panel.

In some embodiments, a curable mixture 60 comprises sand and/or aggregate.

In some embodiments, a curable mixture 60 comprises pigment, thereby imparting predetermined colors to the eventual cured panel. Providing pigment(s) in the curable mixture 60 in various cavities can create the appearance of colored decorative bricks or the appearance of other masonry construction, while an added curable material 54 having a different color will be oriented over the raised portions 26. The resulting cured panel will have the appearance of colored brick and non-colored or different colored mortar joints.

In some embodiments, different curable mixtures 60 can be provided in different cavities 20 to create various decorative effects. For example, curable mixtures 60 in different cavities 20 can comprise different colors.

In some embodiments, a form liner 10 can include an enhancing material 50 in one or more cavities 20 and a curable mixture 60 in one or more cavities 20. In some embodiments, both an enhancing material 50 and a curable mixture 60 can be provided in one or more cavities. In some embodiments, enhancing material 50 can be oriented near the surface of the form liner 10 and curable mixture 60 can cover the enhancing material 50. In some embodiments, enhancing material 50 can be intermixed in the curable mixture 60 or the curable mixture 60 comprises enhancing material 60.

A curable mixture 60 can comprise any suitable combination of cement, sand, aggregate, pigments and/or enhancing materials 50.

In some embodiments, a protective film 70 is provided on the form liner 10. In FIG. 3, a protective film 70 covers the entire form liner 10, and the protective film 70 is illustrated with the front corner raised for clarity. A protective film 70 can comprise any suitable material and often comprises a polymer film. In some embodiments, a protective film 70 is arranged to secure and contain any enhancing material 50 and/or curable mixture 60 in the cavities 20 of the form liner 10 prior to the addition of a curable material 54.

In some embodiments, a protective film 70 is removed prior to the addition of curable material 54.

In some embodiments, a protective film 70 comprises a water soluble or water dispersible material, or a material that will dissolve or disperse upon the application of a curable material 54. Thus, in some embodiments, the protective film 70 can be left in place, and moisture from added water and/or added curable material 54 will dissolve or disperse the protective film 70. In some embodiments, water can be sprayed onto the protective film 70 prior to the addition of curable material 54, to help the film 70 dissolve or disperse, prior to the addition of curable material 54.

In some embodiments, a protective film 70 comprises poly vinyl alcohol or PVOH. In some embodiments, a protective film 70 comprises a polymer as disclosed in U.S. Pat. Nos. 3,734,873 or 7,022,656 or U.S. patent application No. U.S. 20110186468, the entire disclosures of which are hereby incorporated herein by reference.

In some embodiments, a protective film 70 comprises a water soluble film available from MonoSol Corporation, Merrillville, Indiana.

In some embodiments, a protective film 70 is thermoformed or vacuum formed onto the form liner 10. In some embodiments, a protective film 70 will tightly follow the contours of the form liner 10 and any material oriented in the cavities 20.

In some embodiments, a protective film 70 is secured to the form liner 10 with an adhesive. In some embodiments, an adhesive is applied to the raised portions 26, and the protective film 70 is attached to the raised portions 26.

Figure 4:
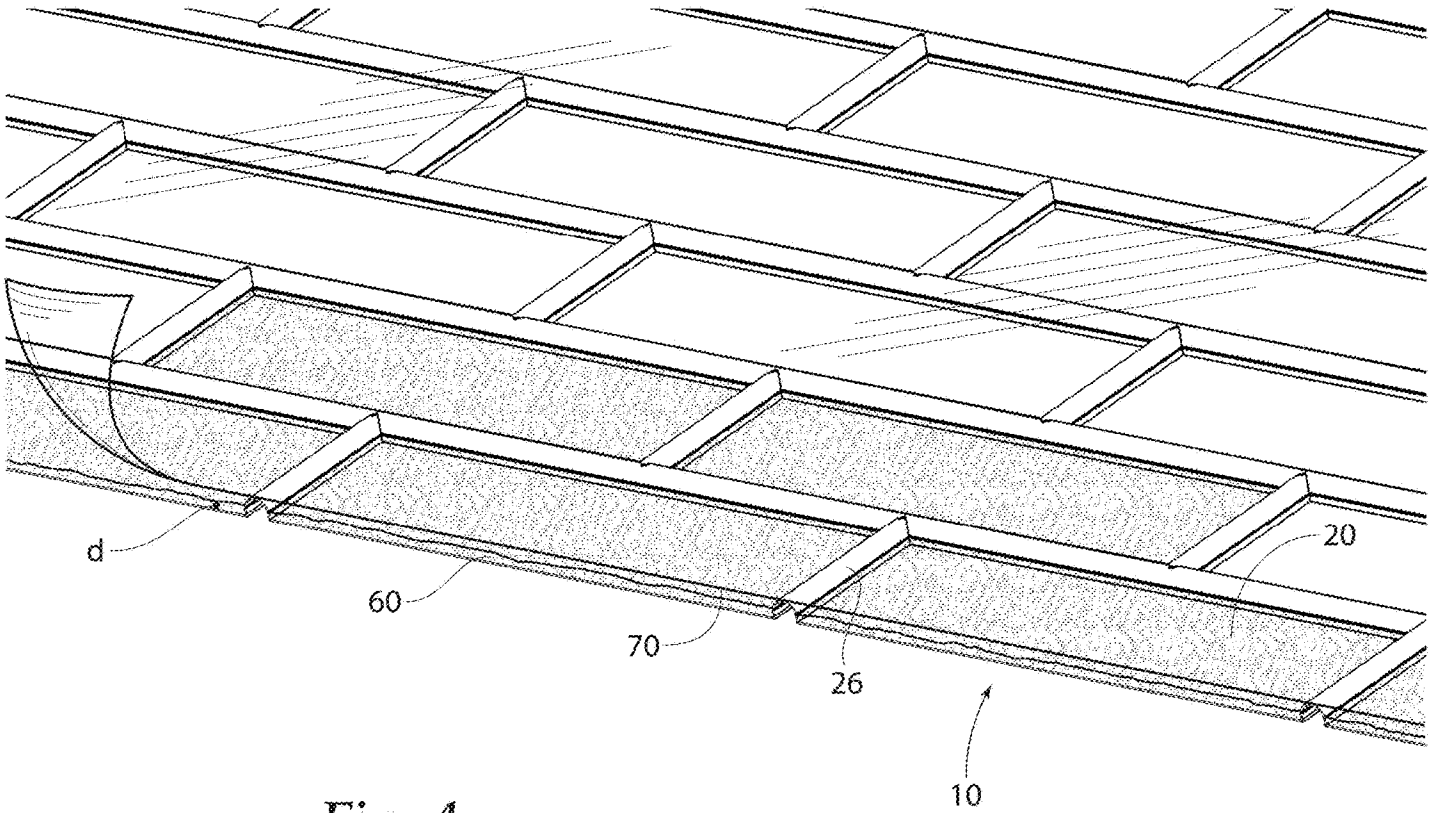
FIG. 4 shows a cross-sectional view of an embodiment of a form liner.

FIG. 4 shows a sectional view of an embodiment of a form liner 10.

Any suitable amount of curable mixture 60 can be provided in a cavity 20. In a typical wall construction, the curable mixture 60 may be provided having a depth d ranging from ⅛" to ¼". A deeper amount of curable mixture 60 can result in a cured panel having a deeper amount of surface decoration. For example, when the curable mixture 60 comprises color pigments, using a deeper amount of curable mixture 60 results in a deeper amount of colored cured material in the eventual cured panel. This will help the cured panel to retain its appearance should a surface of be panel becoe chipped or damaged.

Figure 5:
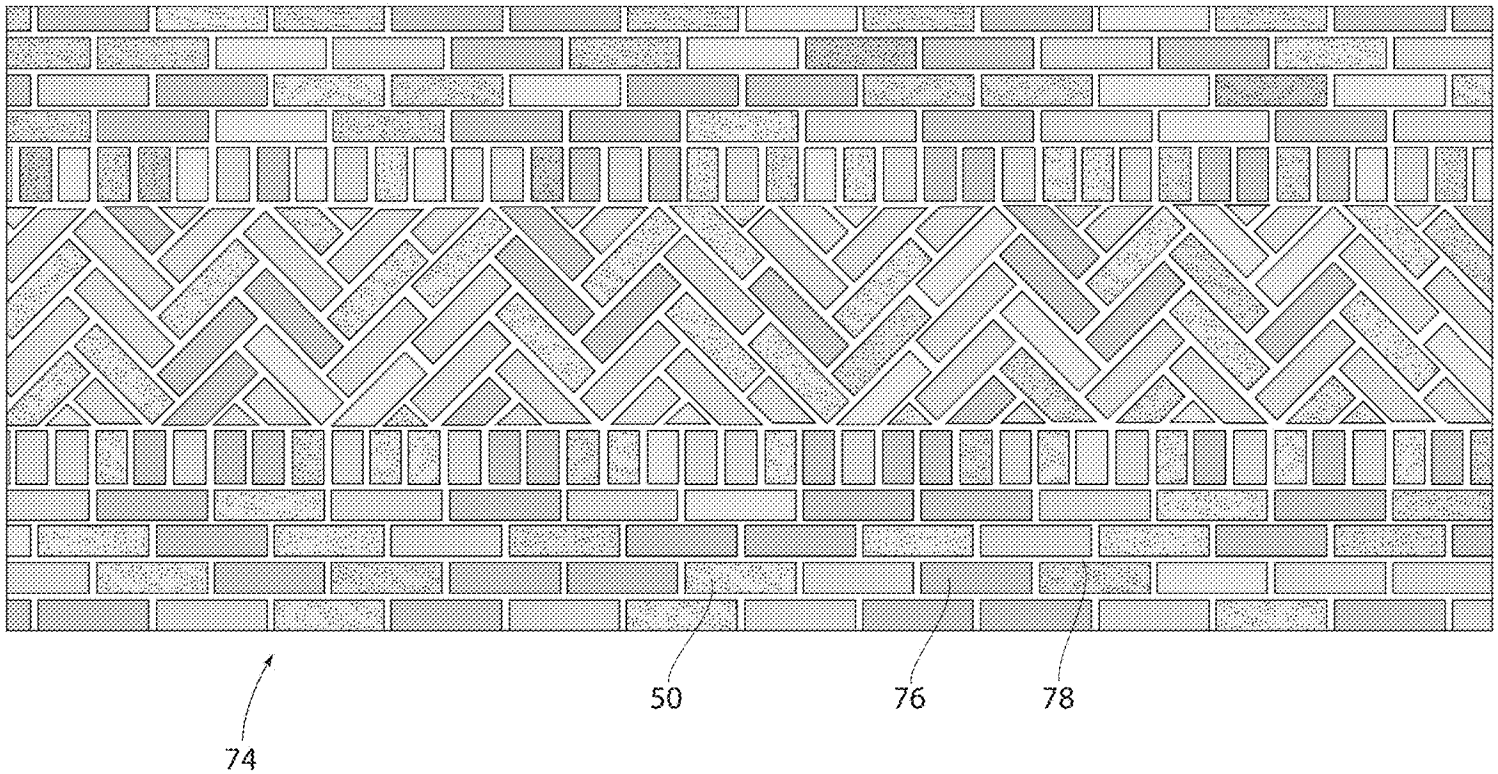
FIG. 5 shows an embodiment of a cured panel.

FIG. 5 shows an embodiment of a cured panel 74, for example having been formed using a form liner 10 comprising curable mixture 60 in various cavities 20. Once the curable material 54 has cured, the form liner 10 can be removed to reveal the cured panel 74. A surface of the cured panel 74 comprises brick portions 76 and joints 78. Curable mixture 60 that was oriented in various cavities 20 becomes the brick portions 76. Curable material oriented over raised portions 26 becomes the joints 78. The cavity 20 arrangements of the form liner 10 can be oriented to form various bond patterns, such as running bond portions, end bond portions and herringbone portions as shown in FIG. 5.

In some embodiments, cured panel comprises a cured material and at least one enhancing material on a surface of the cured material. In some embodiments, a cured material is formed by a process comprising placing an enhancing material in a form liner and applying a curable material.

In some embodiments, a cured panel comprises joints and brick portions, wherein the brick portions comprise a pigment and the joints do not include pigment.

In some embodiments, a method comprises providing a form liner comprising cavities and raised portions, wherein the form liner comprises an enhancing material in at least one cavity. In some embodiments, the enhancing material is oriented in a cavity that is defined by the raised portions. In some embodiments, the method comprises providing a form liner and applying the enhancing material to the form liner. In some embodiments, the method further comprises applying a curable material and allowing the curable material to cure into a cured material, wherein the enhancing material is retained on the cured material.

In some embodiments, a method comprises providing a form liner comprising cavities defined by raised portions, wherein the form liner comprises a curable mixture in at least one cavity. A curable material is added and allowed to cure. In some embodiments, the form liner comprises a film, and the film is removed prior to the addition of curable material. In some embodiments, the form liner comprises a film that is left in place, and a curable material is applied over the film. In some embodiments, the curable material dissolves or disperses the film.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A form liner comprising a plurality of cavities defined by a plurality of raised portions, at least one cavity comprising an enhancing material attached to a surface of said cavity, further comprising a protective film attached to said raised portions, wherein said film is water soluble or water dispersible.

2. The form liner of claim 1, wherein said enhancing material comprises polymer flakes.

3. The form liner of claim 1, wherein said enhancing material comprises glitter.

4. The form liner of claim 1, wherein said enhancing material comprises sand.

5. The form liner of claim 1, wherein said enhancing material comprises a material selected from a group consisting of stone granules, polymer flakes, glitter, sand and color pigment.

6. The form liner of claim 1, wherein said enhancing material comprises color pigment.

7. The form liner of claim 1, further comprising a curable mixture in at least one cavity.

8. The form liner of claim 7, wherein said curable mixture comprises cement.

9. A form liner comprising a plurality of cavities defined by a plurality of raised portions, a color pigment oriented in at least one of said cavities, further comprising a protective film, wherein said protective film is water soluble.

10. The form liner of claim 9, wherein said color pigment comprises a powder.

11. The form liner of claim 9, wherein said protective film is attached to said raised portions.

12. The form liner of claim 9, comprising a curable mixture that comprises said color pigment.

13. The form liner of claim 9, said color pigment comprising a first color pigment oriented in a first cavity, said form liner comprising a second color pigment oriented in a second cavity, said first color pigment having a different color from said second color pigment.

14. The form liner of claim 9, further comprising an enhancing material attached to a surface of at least one cavity.

15. The form liner of claim 9, said cavities arranged in a running bond pattern.

* * * * *